United States Patent [19]

Bajaj

[11] 4,183,200

[45] Jan. 15, 1980

[54] TENNIS RACKET STRING

[75] Inventor: Girdhar Bajaj, Des Plaines, Ill.

[73] Assignee: PepsiCo, Inc., Purchase, N.Y.

[21] Appl. No.: 838,669

[22] Filed: Oct. 3, 1977

[51] Int. Cl.[2] ..... D02G 3/44; D02G 3/36

[52] U.S. Cl. ..... 57/234

[58] Field of Search ..... 57/140 R, 144, 149, 57/150, 153, 154, 210, 225, 232, 234, 235; 428/377, 380, 389

[56] References Cited

U.S. PATENT DOCUMENTS

| | | | |
|---|---|---|---|
| 2,401,291 | 5/1946 | Smith | 57/140 C |
| 2,735,258 | 2/1956 | Crandall | 57/149 X |
| 2,861,417 | 11/1958 | Crandall | 57/149 X |
| 3,024,589 | 3/1962 | Vaughan | 57/149 X |
| 3,050,431 | 8/1962 | Crandall | 57/157 R X |
| 3,738,096 | 6/1973 | Crandall | 57/140 C X |
| 4,016,714 | 4/1977 | Crandall et al. | 57/149 X |
| 4,084,399 | 4/1978 | Kanemaru et al. | 57/232 |

*Primary Examiner*—Donald Watkins

*Attorney, Agent, or Firm*—Hill, Van Santen, Steadman, Chiara & Simpson

[57] ABSTRACT

A string for a tennis racket composed of a synthetic resin such as nylon and having a combination of properties which provides a highly desirable balance between playability and durability. Specifically, the string has a spring rate of from 45 to 65 pounds/inch (8.0 to 11.6 kg/cm) at a loading in the range of 50 to 100 pounds (22.7 to 45.4 kg), the string exhibiting a substantially linear stress-strain behavior in the foregoing range, a minimum tensile break load of 120 pounds (54.4 kg), a thickness of from 0.040 to 0.055 inch (0.10 to 0.14 cm), a minimum overhand knot strength of 50 pounds (22.7 kg), and a minimum surface friction of 0.120.

10 Claims, 3 Drawing Figures

TENNIS RACKET STRING

BACKGROUND OF THE INVENTION

1. Field of the Invention

This invention is in the field of strings designed for use in tennis rackets, the strings having a combination of physical properties such as spring rate, tensile strength, thickness, overhand knot strength, surface friction, damping capacity, bend fatigue, double loop strength, and the like making them particularly suited for this purpose.

2. Description of the Prior Art

Traditionally, the tennis player has had a choice of strings to put on his racket, the choice depending upon such factors as ability and cost. The better players have almost invariably chosen strings made of animal gut because such strings are performance oriented, exhibiting high playability even though durability is relatively low. Players of intermediate ability have gone to strings having perhaps less playability with a higher durability while the beginner may choose a string with the lowest playability but the highest durability. While nylon strings composed of a solid core about which nylon strands are wrapped are old, per se, to my knowledge no one has previously correlated the various physical factors which go into improving the playability and improving the durability of the strings.

SUMMARY OF THE INVENTION

The present invention is directed to a tennis string whose physical properties have been adjusted so that there is a good correlation between playability and durability. Specifically, in this invention I provide a tennis racket string composed of a solid filamentary core having strands wound thereabout and adhesively secured thereto, both the core and the strands being composed of a synthetic resin such as nylon. The string has a spring rate of 45 to 65 pounds/inch (51.8 to 74.9 kg/cm) at a loading in the range of 50 to 100 pounds (22.7 to 45.4 kg), the string exhibiting a substantailly linear stress-strain behavior in this range. The string has a minimum tensile break load of 120 pounds (54.4 kg) at a thickness of 16 gauge (0.051 in. 0.01 cm), and a thickness range of from 0.040 to 0.055 inch (0.10 to 0.14 cm). It has a minimum overhand knot strength of 50 pounds (22.7 kg), and a minimum surface friction of 0.120 as defined herein. Preferably, the tennis racket string also has a damping capacity of 0.470 to 0.750 and a 180° bend fatigue value of at least 5 minutes. The tennis racket string further has a double loop strength of at least 90% of its minimum knot strength.

In the preferred form of the invention, the tennis racket string has a thickness of from 0.045 to 0.0530 inch (0.114 to 0.135 cm), a minimum break load of 135 pounds (61.2 kg), a minimum knot strength of 70 pounds (31.8 kg), and a surface friction of from 0.150 to 0.400.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
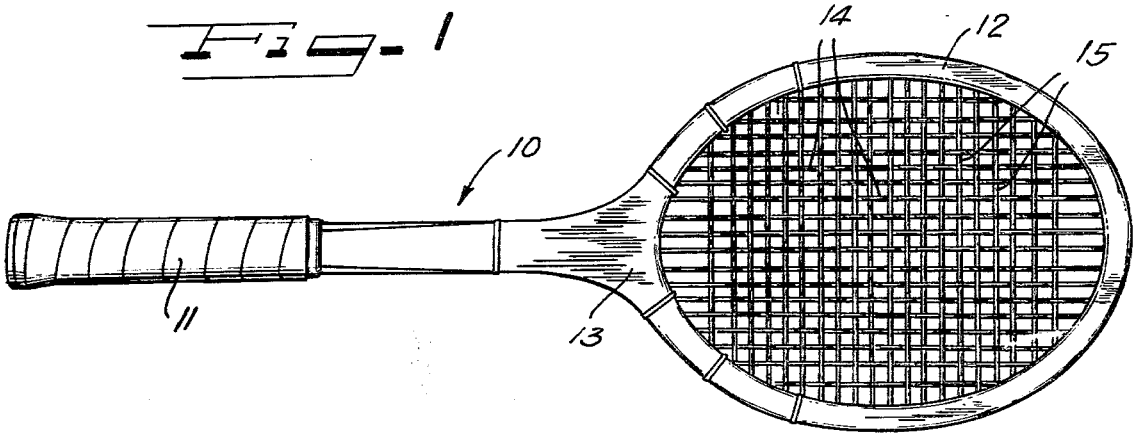
FIG. 1 is a plan view of a conventional type tennis racket employing the strings of the present invention.

An engineering evaluation has determined that many different factors of varying degrees of relevance go into the playability and the durability of a string. For example, playability of a string has been found to be determined by:

1. A constant spring rate of a specific value between a loading of 50 and 100 pounds (22.7 to 45.4 kg).
2. Outside diameter
3. Friction and surface texture.
4. Damping capacity.

Spring rate is defined as the load per unit deflection. A constant spring has the same ratio of load to deflection for any given load. A constant spring rate exhibits a straight line relation on a curve plotting deflection against load. A constant spring rate is, according to my view, the main contributing factor of playability and its influence on the playability of the string has been determined by corelation to be about 65%. Broadly speaking, the string should have a spring rate of 45 to 65 pounds/inch (8.0 to 11.6 kg/cm) at a loading in the range of 50 to 100 pounds (22.7 to 45.4 kg) and should exhibit a substantially linear relationship between its load deflection curve within that range.

The outside diameter contributes toward playability as well as durability. It affects the spring rate, spin capability and the sound of the string. As far as durability is concerned, it affects the tensile strength. It has been determined by correlation that the outside diameter contribution toward playability is approximately 15%. I have further determined that the spring rate and the breaking load of the string is directly proportional to the square of the diameter of the string.

String tackiness affects the degree or extent of frictional gripping of the string. Surface texture is a function of the outer surface construction of the string and also affects gripping ability. A substantial amount of gripping action is desired on a tennis racket string because it increases the ball's traction on the string during impact and thereby provides better control. Surface tackiness and texture are important since they are also related to the ability of the string to grip the ball and the string's ability to impart spin to the ball. It is estimated that the weighted effect of tackiness and surface texture is approximately 10% of playability. The friction test can be carried out by training the string over a friction wheel with a weight at each end. Additional incremental weights are added to one side until the string starts to move. The coefficient of friction is then calculated.

Damping capacity is the measure of the ability of a material to absorb vibration and convert the mechanical energy into heat. It is equal to the area of the elastic hysteresis loop divided by the deformation energy of a vibrating material. Elastic hysteresis is defined as the difference between the strain energy required to generate a given stress in the material and the elastic energy at that stress. Elastic hysteresis is energy dissipated as heat in a material in one cycle of dynamic testing. Deformation energy is defined as the energy required to deform a material to a specified amount. It is the area under the stress-strain diagram up to a specified strain and can be determined by generating an elastic hysteresis loop curve and a deforming energy curve with the aid of a stress-strain plotter. Then these curves are weighted very accurately and friction of the weights gives the damping capacity. The sound generated by the ball upon impact is related to the damping capacity of the string. Overall, the weighted effect of the damping capacity of the string toward playability is approximately 10%.

The durability of the string is primarily determined by four physical characteristics:

1. Breaking load strength.
2. Knot strength.
3. 180° bend fatigue strength.
4. Notch sensitivity.

The breaking load string (tensile strength) is the load which causes failure when the string is loaded in tension. This test is performed in the usual way, utilizing an "Instron" testing machine. Each string is mounted securely and loaded under tension until string failure occurs. This is the primary characteristic contributing to durability and its weighted effect upon durability is correlated to be 60%.

Knot strength is the measure of a string's sensitivity to compressive and shear strength. In making this test, the sample string is formed into an overhand knot and then clamped to the testing machine and loaded until string failure occurs. Knot strength contributes 10% toward durability.

The notch sensitivity test is performed by notching a sample of the string using commercial wire strippers. The notched strings are then clamped and loaded under tension until failure occurs. This test measures the reduction load carrying abilities caused by a notch stress concentration in a specimen. It has been determined that this factor contributes 20% toward durability.

The 180° bend fatigue strength is a measure of the string's capability to retain its tensile strength over a sharp radius and under fatigue conditions. In running this test, the string under test is passed through a wire crown wrap of the type used in steel tennis rackets and the string is then pulled back and forth across the wrap under a constant tension and at a constant speed until failure. Time of failure is recorded to the nearest second. It has been determined that this factor contributes approximately 10% toward durability.

Turning now to the drawings, in FIG. 1 reference numeral 10 indicates generally a tennis racket composed of metal or wood and including a handle portion 11, a racket head 12 and a yoke 13 connecting the two. As in conventional tennis rackets, the head is strung with longitudinally extending strings 14 and transverse strings 15. The specific means for attaching these strings to the racket forms no part of the present invention.

Figure 3:
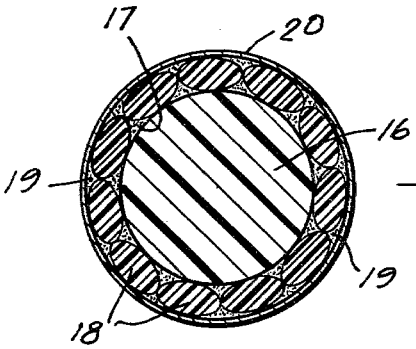
FIG. 3 is a cross-sectional view taken substantially along the line III—III of FIG. 2.
Figure 2:
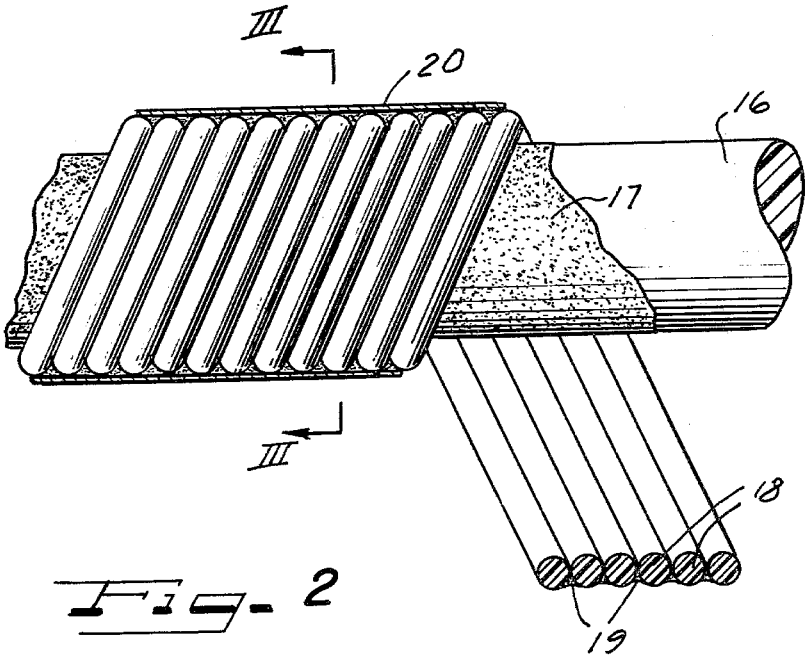
FIG. 2 is a greatly enlarged development illustrating the manner in which the synthetic resin strands are wound about the core.

The details of the string itself are best illustrated in FIGS. 2 and 3 of the drawings. As shown, the string includes a solid filamentary core 16 typically having a diameter of 0.85 to 0.95 mm. The core is covered on its outer surface by means of an adhesive layer 17 suitable for the particular synthetic resin material being used. For example, in the case of nylon, the adhesive layer 17 may be composed of about 31% phenol, 66.5% dichlorethane and 2.5% nylon.

A plurality of strands 18 also composed of nylon are cemented together by means of an adhesive 19 which adhesive may typically consist of 42% phenol, 50% dichlorethane and 8% nylon. The strands 18 are wound around the filamentary core 16 in a helical fashion as illustrated in FIG. 2, and thereafter the entire outer surface of the string is provided with an adhesive layer 20 which may typically consist of an aldehyde condensation product of rosin, a hydrogenated terpene resin in a xylene or other solvent. As shown in FIGS. 2 and 3, the strands 18 are adhesively united to the core without degradation and the continuous resin layer 20 is composed solely of adhesive bonded to the string. The diameter of the core 16 is typically from 3 to 6 times the thickness of the strands 18.

Tests have shown that an excellent balance between playability and durability results when the overall diameter of the string is 0.040 to 0.055 inch (0.102 to 0.140 cm) and more preferably of from 0.045 to 0.0530 inch (0.114 to 0.135 cm), the string has a spring rate of 45 to 65 pounds/inch (8.0 to 11.6 kg/cm) at a loading in the range of 50 to 100 pounds (22.7 to 45.4 kg), with the string exhibiting a substantially linear stress-strain behavior within that range. The string should have a minimum tensile break load of 120 pounds (54.4 kg) and a minimum overhand knot strength of 50 pounds (22.7 kg). It should have a minimum surface friction as previously defined of 0.120 and a damping capacity of 0.470 to 0.750. Its 180° bend fatigue value should be at least 5 minutes and it should have a double loop strength of at least 90% of its knot strength. When these conditions are met, the string has a playability equivalent to or better than that of a gut string while its durability is substantially better than a gut string.

It should be evident that various modifications can be made to the described embodiments without departing from the scope of the present invention.

I claim as my invention:

1. A tennis racket string comprising a solid mono-filamentary core having strands wound thereabout and adhesively secured thereto without degradation of the strands, both said core and said strands being composed of a synthetic resin, said core having a thickness of three to six times the thickness of the strand, said string having a spring rate of from 45 to 65 pounds/inch (8.0 to 11.6 kg/cm) at a loading in the range of 50 to 100 pounds (22.7 to 45.4 kg), said string exhibiting a substantially linear stress-strain behavior in said range, a minimum tensile break load of 120 pounds (54.4 kg), a total thickness of from 0.040 to 0.055 inch (0.102 to 0.140 cm), a minimum overhand knot strength of 50 pounds (22.7 kg), and said strands being encased by a separate continuous, smooth outer resin layer composed solely of a set resin adhesive bonded to the string thereby providing said string with an improved surface texture.

2. A tennis racket string according to claim 1 in which said synthetic resin is nylon.

3. A tennis racket string according to claim 1 which has a damping capacity of 0.470 to 0.750.

4. A tennis racket string according to claim 1 which has a 180° bend fatigue value of at least 5 minutes.

5. A tennis racket string according to claim 1 which has a double loop strength of at least 90% of its minimum knot strength.

6. A tennis racket string according to claim 1 which has a uniform thickness of from 0.045 to 0.0530 inch (0.114 to 0.135 cm).

7. A tennis racket string according to claim 1 which has a minimum break load of 135 pounds (61.2 kg).

8. A tennis racket string according to claim 1 which has a minimum knot strength of 70 pounds (31.8 kg).

9. A tennis racket string according to claim 1 which has a surface friction of from 0.150 to 0.400.

10. A tennis racket string comprising a solid core of nylon mono-filament and nylon strands of substantially less thickness wound about said core and adhesively secured thereto without degradation of the strands, said string having a spring rate of 45 to 65 pounds/inch (51.8 to 74.9 kg/cm) at a loading in the range from 50 to 100 pounds (22.7 to 45.4 kg) and exhibiting a substantially linear stress-strain behavior in said range, a total thickness of from 0.045 to 0.0530 inch (0.114 to 0.135 cm), a minimum break load of 135 pounds (61.2 kg), a minimum knot strength of 70 pounds (31.8 kg), and said strands being encased by a separate, continuous, smooth outer resin layer composed solely of a set resin adhesive bonded to the string, thereby providing said string with an improved surface texture.

* * * * *